US005956366A

United States Patent [19]

Shimizu et al.

[11] Patent Number: 5,956,366

[45] Date of Patent: Sep. 21, 1999

[54] ARC FURNACE AND METHOD IN WHICH MOLTEN MATERIAL IS STIRRED AND THE ARC IS GUIDED

[75] Inventors: Hiroshi Shimizu, Wexford; Joseph L. Hake, New Castle; Richard L. Cook, Pittsburgh, all of Pa.

[73] Assignee: NKK Steel Engineering, Inc., Mars, Pa.

[21] Appl. No.: 08/807,803

[22] Filed: Feb. 26, 1997

[51] Int. Cl.[6] ..... H05B 7/144

[52] U.S. Cl. ..... 373/108; 373/85; 373/107

[58] Field of Search ..... 373/107, 108, 373/101–106, 85

[56] References Cited

U.S. PATENT DOCUMENTS

| | | | |
|---|---|---|---|
| 586,822 | 7/1897 | Patten | 373/107 |
| 2,652,440 | 9/1953 | Simmons | 373/107 |
| 2,727,936 | 12/1955 | Boyer | 373/107 |
| 3,683,094 | 8/1972 | Schlienger | 373/107 |
| 4,110,546 | 8/1978 | Stenkvist | 373/107 |
| 4,149,024 | 4/1979 | Stenkvist et al. | 373/108 |
| 4,931,702 | 6/1990 | Voronin et al. | 373/107 |
| 5,317,591 | 5/1994 | Stenkvist | 373/107 |
| 5,526,374 | 6/1996 | Uebber | 373/107 |

*Primary Examiner*—Tu Ba Hoang
*Attorney, Agent, or Firm*—Ansel M. Schwartz

[57] ABSTRACT

A direct current electric arc furnace for melting or heating raw material or molten material. The furnace includes a refractory lined vessel for holding raw or molten material in its interior. The furnace includes at least a first top electrode. The first top electrode enters the vessel interior above the raw or molten material. The furnace includes at least a first bottom electrode mounted in the bottom of the vessel and in electrical contact with the raw or molten material in the vessel. The furnace also includes an electrical power supply mechanism which electrically connects to the top electrode and the bottom electrode in order to input electrical energy into the material through the top and bottom electrodes in the form of an arc. The bottom electrode has an opposite electrical polarity to the electrical polarity of the top electrode. The furnace includes a mechanism for stirring the molten material in the vessel and guiding the arc in the vessel. The stirring and guiding mechanism is in communication with the interior of the vessel. A method for operating a direct current arc furnace.

14 Claims, 10 Drawing Sheets

PATENT (1) : DC140.0[kA]

(2)

B X : −0.2[G]

B Y : 0.1[G]

B Z : 150.2[G]

: B : : 150.2[G]

PATENT (1) : DC140.0[kA]

(2)

B X : 0.0[G]

B Y : 0.0[G]

B Z : 114.3[G]

: B : : 114.3[G]

ARC FURNACE AND METHOD IN WHICH MOLTEN MATERIAL IS STIRRED AND THE ARC IS GUIDED

CROSS-REFERENCE

This application is related to contemporaneously filed U.S. patent application Ser. No. 08/806,848 titled "A Method and Apparatus for Heating Materials" by Hiroshi Shimizu, Joseph L. Hake, and Richard L. Cook, having attorney docket number NKK-1, incorporated by reference herein, and U.S. patent application Ser. No. 08/806,204 titled "A Method and Apparatus for Operating a Furnace" by Hiroshi Shimizu, Joseph L. Hake, and Richard L. Cook, having attorney docket number NKK-2, incorporated by reference herein.

FIELD OF THE INVENTION

The present invention is related to a direct current arc furnace. More specifically, the present invention is related to a direct current arc furnace having a turn coil to provide magnetic fields to direct the arc downward and provide maximum stirring action in the molten material.

BACKGROUND OF THE INVENTION

Previous large DC arc furnaces by means of a large power supply and a single top electrode generate an arc between the tip of the top electrode and the material to be melted/heated. The path of this arc tends to deflect away from a true vertical path towards the sidewall of the furnace possibly causing damage to the sidewall refractory and water-cooled panels.

With the use of a turn coil, defined as a current conductor (s) which encircles the arc, disposed below the furnace bottom, a magnetic field is generated in the arc area such that the forces in that magnetic field tend to deflect the arc in a more vertical path, thereby reducing the potential damage to the furnace sidewall refractory and water-cooled panels.

Furthermore, previous large DC arc furnaces, after melting the charge material, provide by the presence of the arc itself stirring of the molten material. This stirring tends to improve the homogenization and reduce the temperature stratification of the molten material which is desirable. However, this stirring action is somewhat limited and as a result, other ways of stirring, such as gas injection with the use of bottom tuyeres or handheld or machine held top lances are utilized. The above-mentioned turn coil provides the additional stirring required as well as performs the necessary control of the arc deflection, eliminating the necessity of other methods of stirring.

SUMMARY OF THE INVENTION

The present invention pertains to a direct current electric arc furnace for melting or heating raw material or molten material. The furnace comprises a refractory lined vessel for holding raw or molten material in its interior. The furnace comprises at least a first top electrode. The first top electrode enters the vessel interior above the raw or molten material. The furnace comprises at least a first bottom electrode mounted in the bottom of the vessel and in electrical contact with the raw or molten material in the vessel. The furnace also comprises an electrical power supply mechanism which electrically connects to the top electrode and the bottom electrode in order to input electrical energy into the material through the top and bottom electrodes in the form of an arc. The bottom electrode has an opposite electrical polarity to the electrical polarity of the top electrode. The furnace comprises a mechanism for stirring the molten material in the vessel and guiding the arc in the vessel. The stirring and guiding mechanism is in communication with the interior of the vessel.

The present invention pertains to a method for operating a direct current arc furnace. The method comprises the steps of guiding direct current from an electrical power supply mechanism to a bottom electrode connected to a refractory lined vessel in a current path defined by an electrical conductor connected to the bottom electrode and the power supply mechanism which loops about a center axis of the vessel. Then there is the step of melting metal in the vessel with an arc that is formed from a first top electrode which has direct current provided to it, and has an electrical polarity opposite of the electrical polarity of the bottom electrode. Next there is the step of stirring the molten metal with forces generated by a magnetic field created by the current in the conductor.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
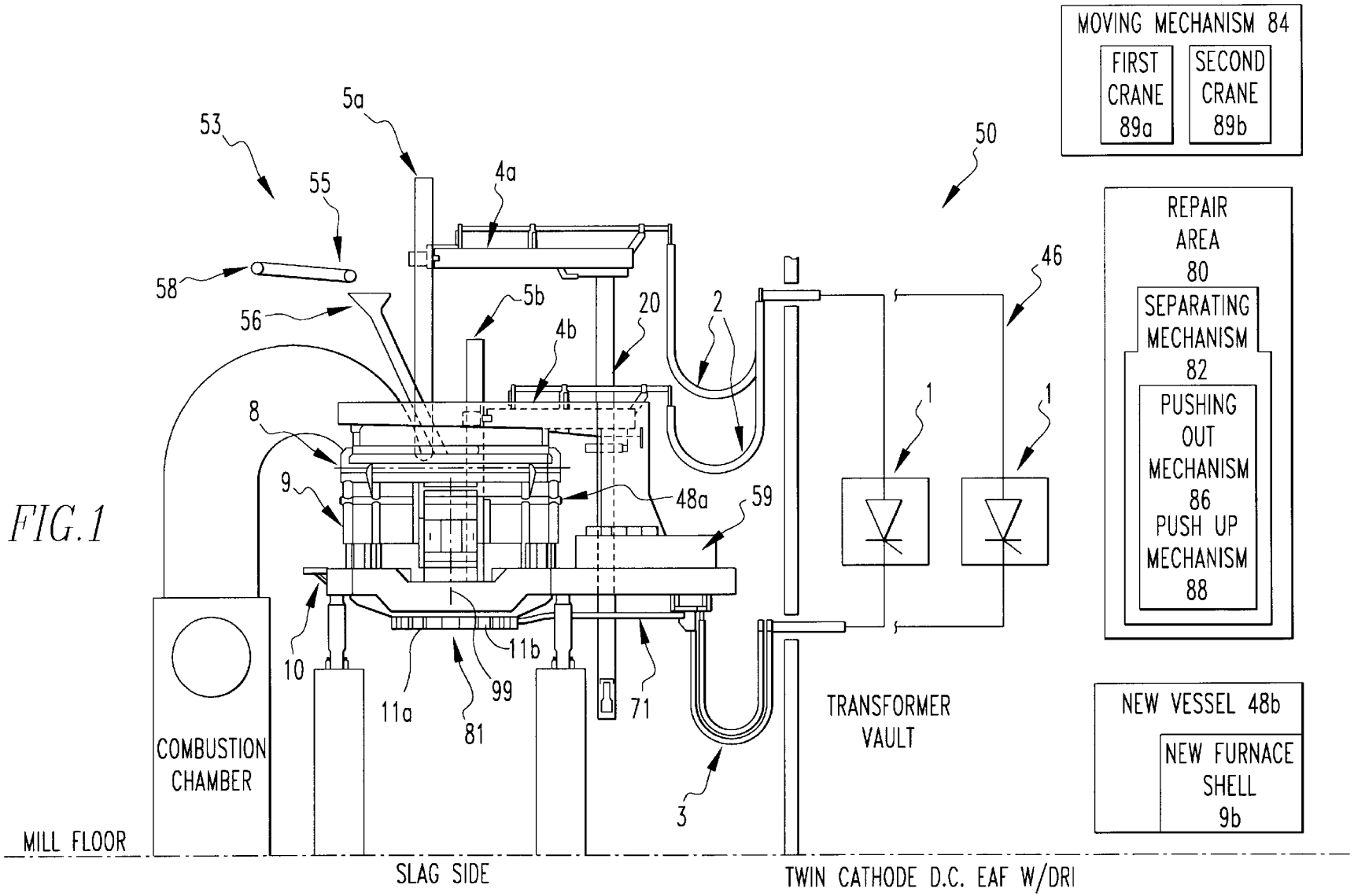
FIG. 1 is a schematic representation of a furnace of the present invention.
Figure 2:
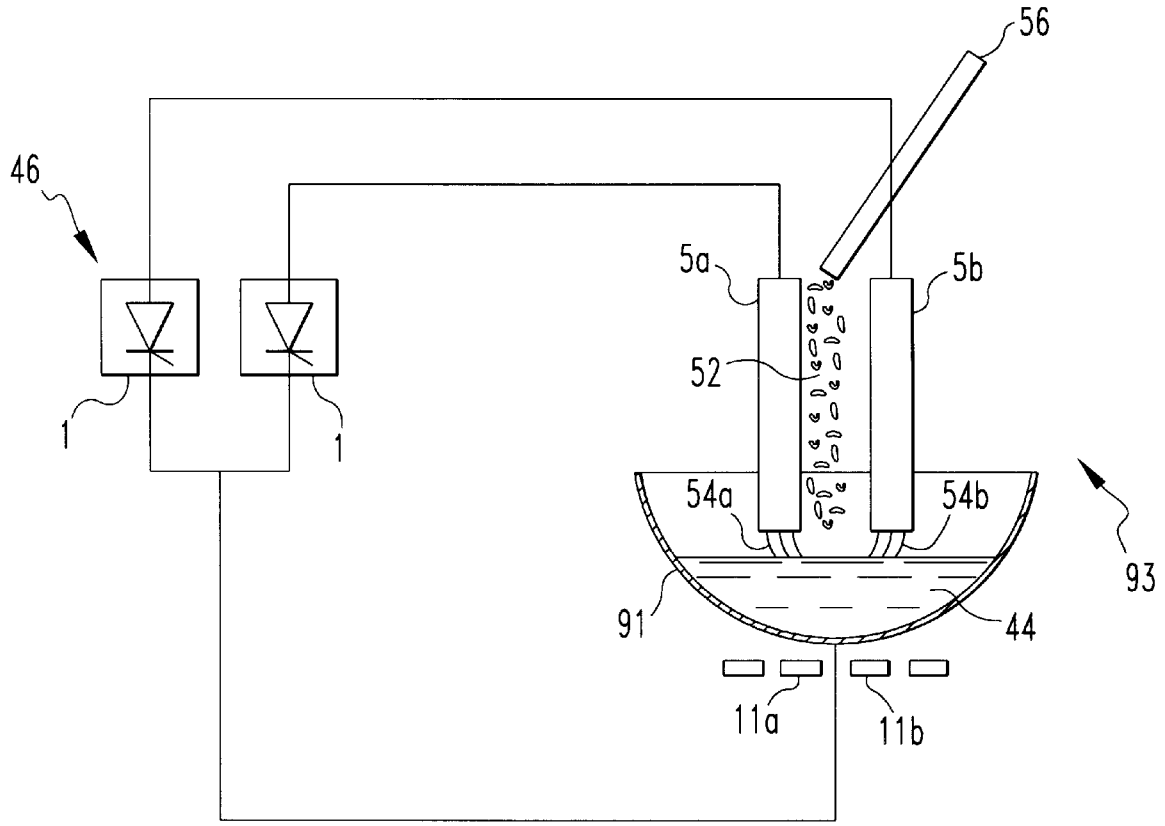
FIG. 2 is a schematic representation of a portion of the furnace.

Referring now to the drawings wherein like reference numerals refer to similar or identical parts throughout the several views, and more specifically to FIGS. 1 and 2 thereof, there is shown a direct current electric arc furnace 50 for melting or heating raw material 44 or molten material 44, such as metal 44. The furnace 50 comprises a refractory lined vessel 48 for holding raw or molten material 44 in its interior. The furnace 50 comprises at least a first top electrode 5*a*. The first top electrode 5*a* enters the vessel 48 interior above the raw or molten material 44. The furnace 50 comprises at least a first bottom electrode 11*a* mounted in the bottom of the vessel 48 and in electrical contact with the raw or molten material 44 in the vessel 48. The furnace 50 also comprises an electrical power supply mechanism 46 which electrically connects to the first top electrode 5*a* and the first bottom electrode 11*a* in order to input electrical energy into the material 44 through the top and bottom electrodes in the form of an arc 54. The first bottom electrode 11*a* has an opposite electrical polarity to the electrical polarity of the top electrode 5*a*. The furnace 50 comprises a mechanism 81 for stirring the molten material 44 in the vessel 48 and guiding the arc 54 in the vessel 48. The stirring and guiding mechanism 81 is in communication with the interior of the vessel 48.

Preferably, the stirring and guiding mechanism 81 connects with the power supply mechanism 46. The stirring and guiding mechanism 81 preferably also provides electrical current to the first bottom electrode 11*a*. Preferably, the stirring and guiding mechanism 81 includes an electrical conductor 71 connected to the power supply mechanism 46 and the first bottom electrode 11*a*.

Figure 3:
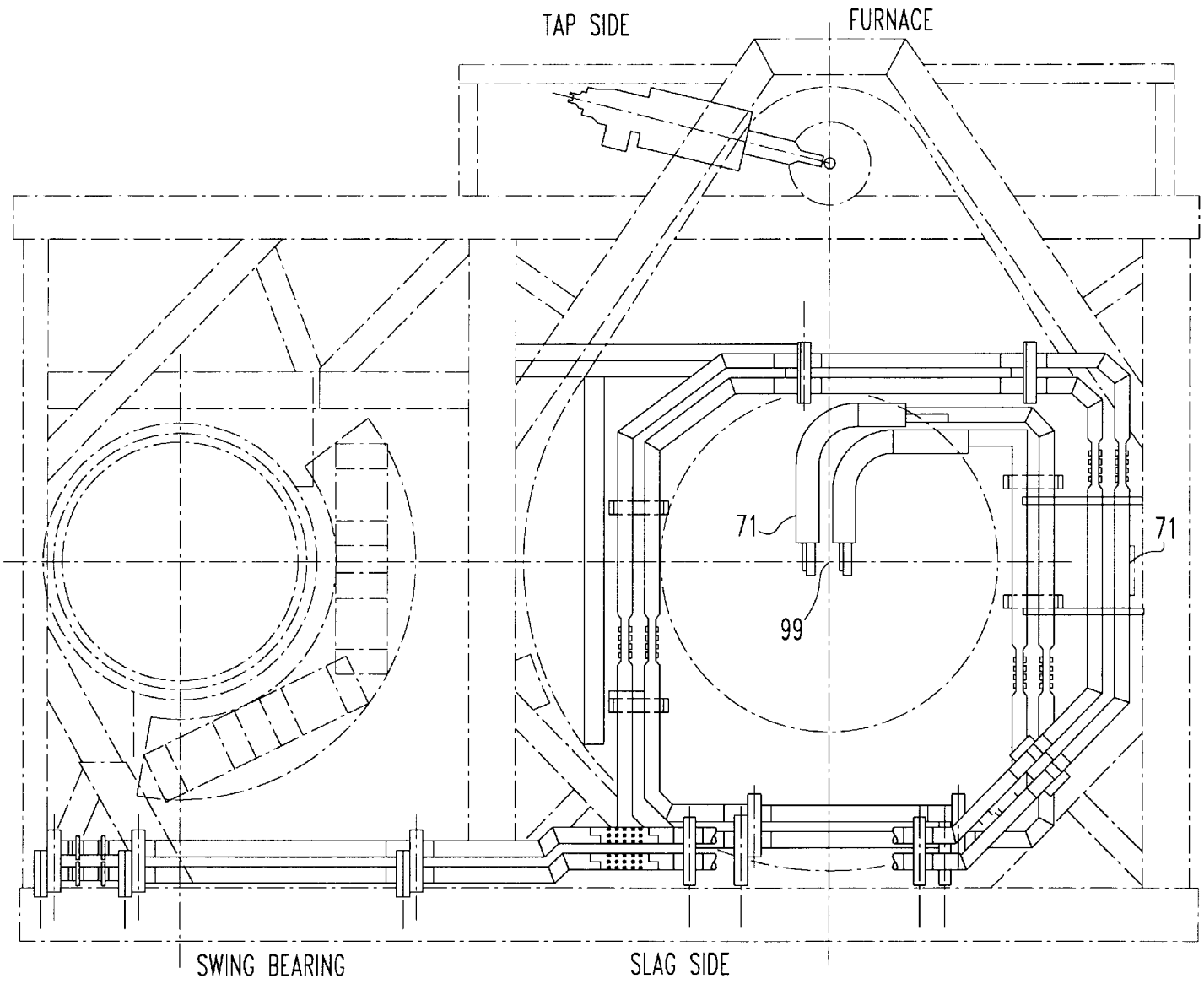
FIG. 3 is a schematic representation of an overhead view of an electrical conductor of the present furnace.

The vessel 48 preferably has a vertical direction and a horizontal direction. The molten metal 44 creates a pool 91 having a surface which forms a plane 93 parallel with the horizontal direction of the vessel 48 when the molten metal 44 is molten. The electrical conductor 71 is preferably configured to generate magnetic fields which limit the deflection of the arc 54 in the horizontal direction and directs deflection of the arc 54 in the vertical direction. The conductor 71 is preferably disposed outside of the vessel 48. Preferably, the vessel 48 has a vertical center axis 99 and the conductor 71 forms a loop essentially in the horizontal direction about the vertical center axis 99, as shown in FIG. 3. The conductor 71 preferably forms at least one closed loop essentially in the horizontal direction about the vertical center axis 99.

The current carried by the conductor 71 to the first bottom electrode 11*a* is limited only by the components of the furnace 50 itself. Preferably, the current carried by the conductor 71 to the first bottom electrode 11*a* is 140 KA. The conductor 71 preferably produces a magnetic field of at least 100G in the vertical direction and less than 10G in the horizontal direction. The magnetic field in the vertical direction should be at least 100G to attain the desired control over deflection of the arc and to attain the desired stirring of the melted metal 44. Preferably, the conductor 71 produces a magnetic field of at least 140G in the vertical direction and less than 1G in the horizontal direction. Alternatively, the conductor 71 produces a magnetic field of at least 100G in the vertical direction and less than 0.5G in the horizontal direction.

The present invention pertains to a method for operating a direct current arc furnace 50. The method comprises the steps of guiding direct current from an electrical power supply mechanism 46 to a first bottom electrode 11*a* connected to a refractory lined vessel 48 in a current path defined by an electrical conductor 71 connected to the first bottom electrode 11*a* and the power supply mechanism 46 which loops about a center axis 99 of the vessel 48. Then there is the step of melting metal 44 in the vessel 48 with an arc 54 that is formed from a first top electrode 5*a* which has direct current provided to it, and has an electrical polarity opposite of the electrical polarity of the first bottom electrode 11*a*. Next there is the step of stirring the molten metal 44 with forces generated by a magnetic field created by the current in the conductor 71.

Preferably, the stirring step includes at the same time deflecting the arc 54 essentially entirely in a vertical direction while essentially preventing the arc 54 from deflecting in a horizontal direction with the magnetic field.

In the operation of the preferred embodiment and referring to FIGS. 1–3, the DC arc furnace comprises a refractory lined furnace shell 9 to contain the material to be melted, a furnace cover 8 to contain the heat energy in the furnace shell, one or more top electrodes 5, typically of graphite, protruding through the furnace cover 8 and capable of moving vertically in order to establish and arc between the tip of the electrode and the material 44 to be melted, an electrode arm 4 for each top electrode to support the electrode, a movable mast 20 to raise and lower the electrode, one or more bottom electrodes 11 located in the bottom of the furnace shell 9, one or more DC power supplies 1 to provide the necessary electrical energy to the furnace for melting, the necessary anode and cathode water cooled cables 2 and 3 to conduct the electrical energy from the power supplies to the furnace, typically the anode connections 3 go to the bottom electrode 11 and the cathode connections 2 to the top electrode 5. There is a tilt platform 10 which supports the furnace vessel 48, the superstructure 59, the electrode arms 4*a* and 4*b* and the electrodes 5*a* and 5*b* and provides for the capability to tilt the furnaces for tapping purposes and slagging off purposes.

Figure 4:
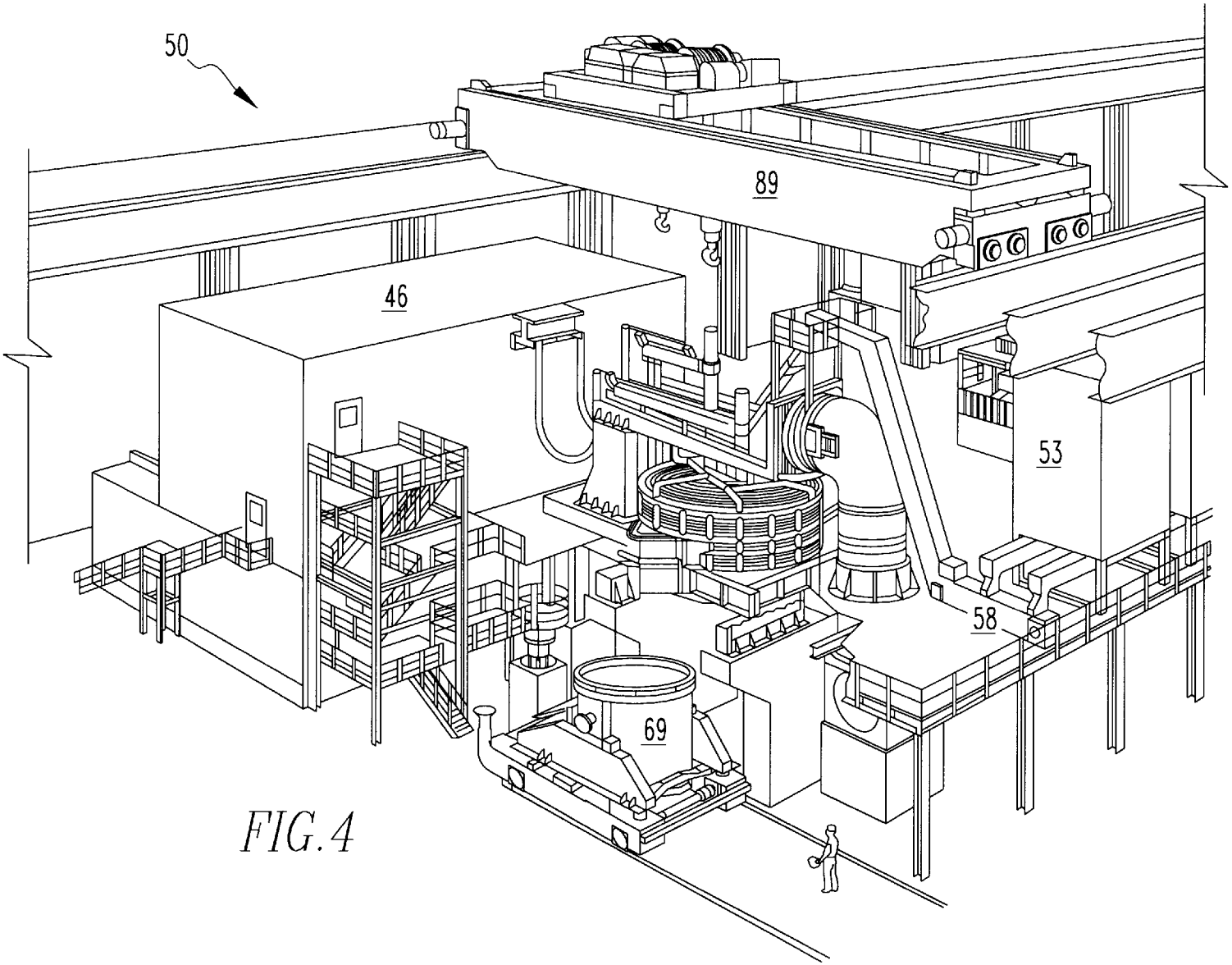
FIG. 4 is a schematic representation of the perspective view of the furnace.
Figure 5A:
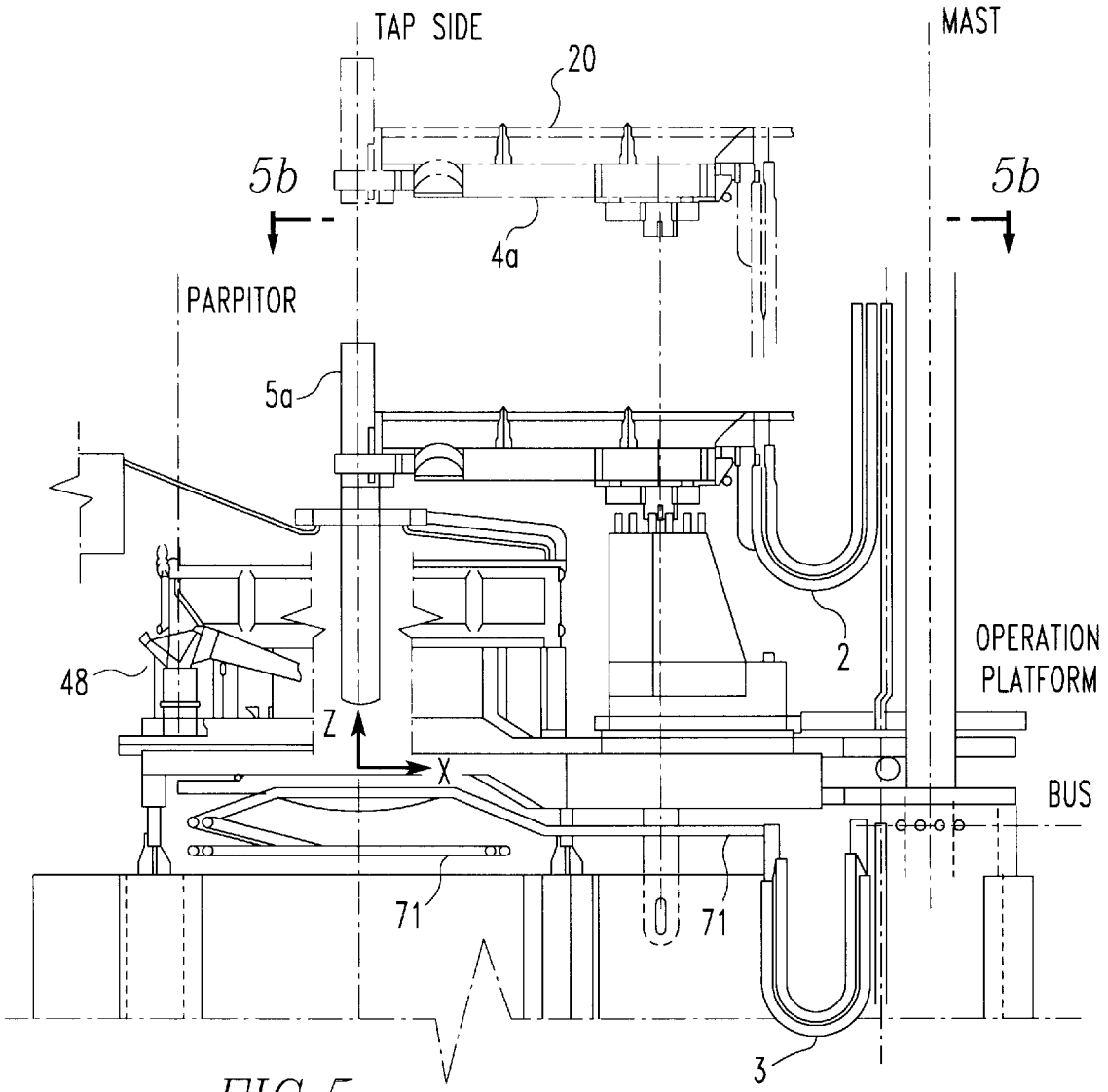
FIG. 5*a* is a schematic representation of a side view of the furnace.
Figure 5B:
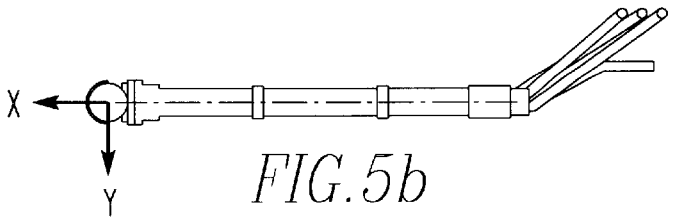
FIG. 5*b* is a schematic representation of a sectional view of FIG. 5*a*.
Figure 6:
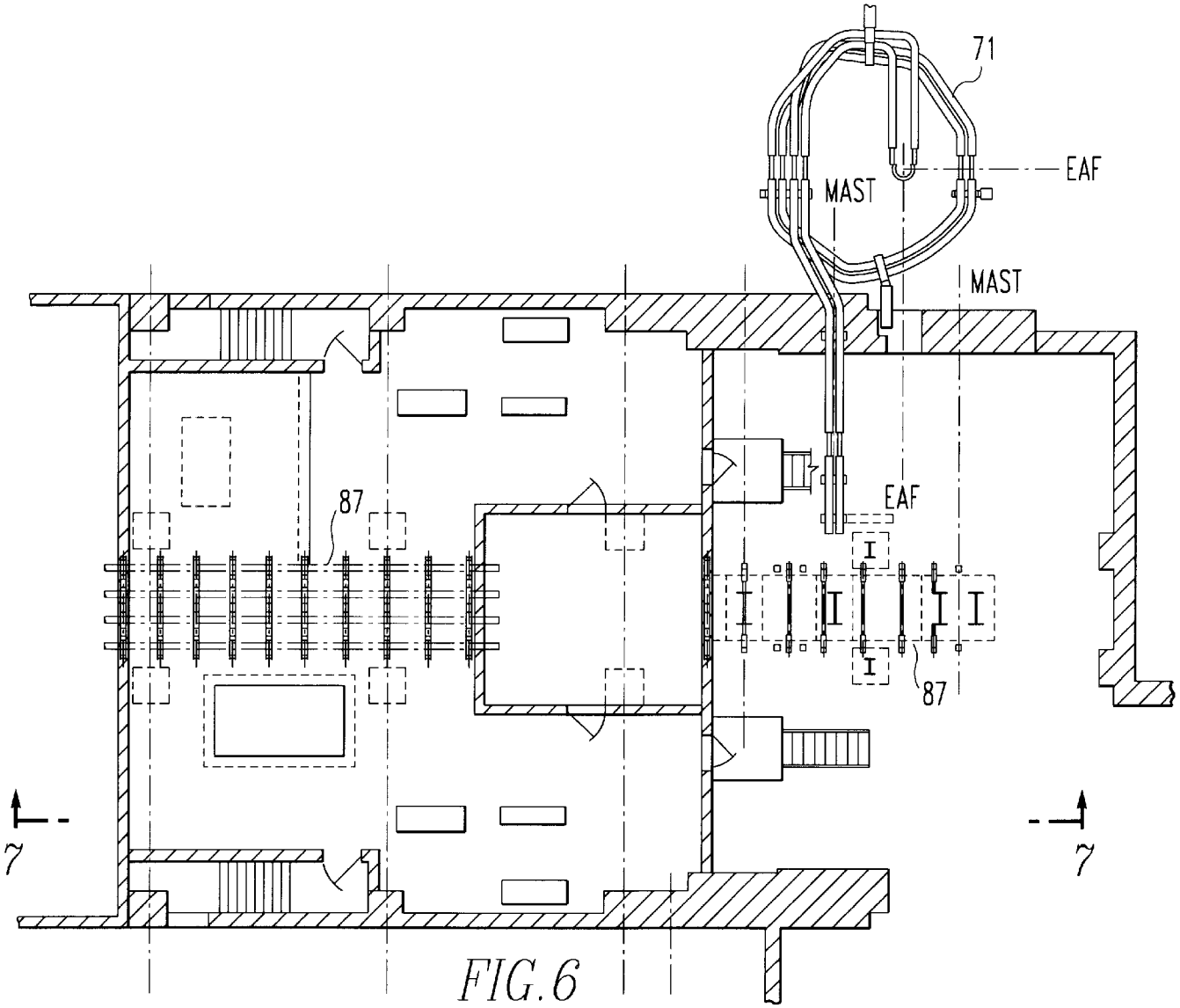
FIG. 6 is a schematic representation of an overhead view of a bus and a conductor.
Figure 7:
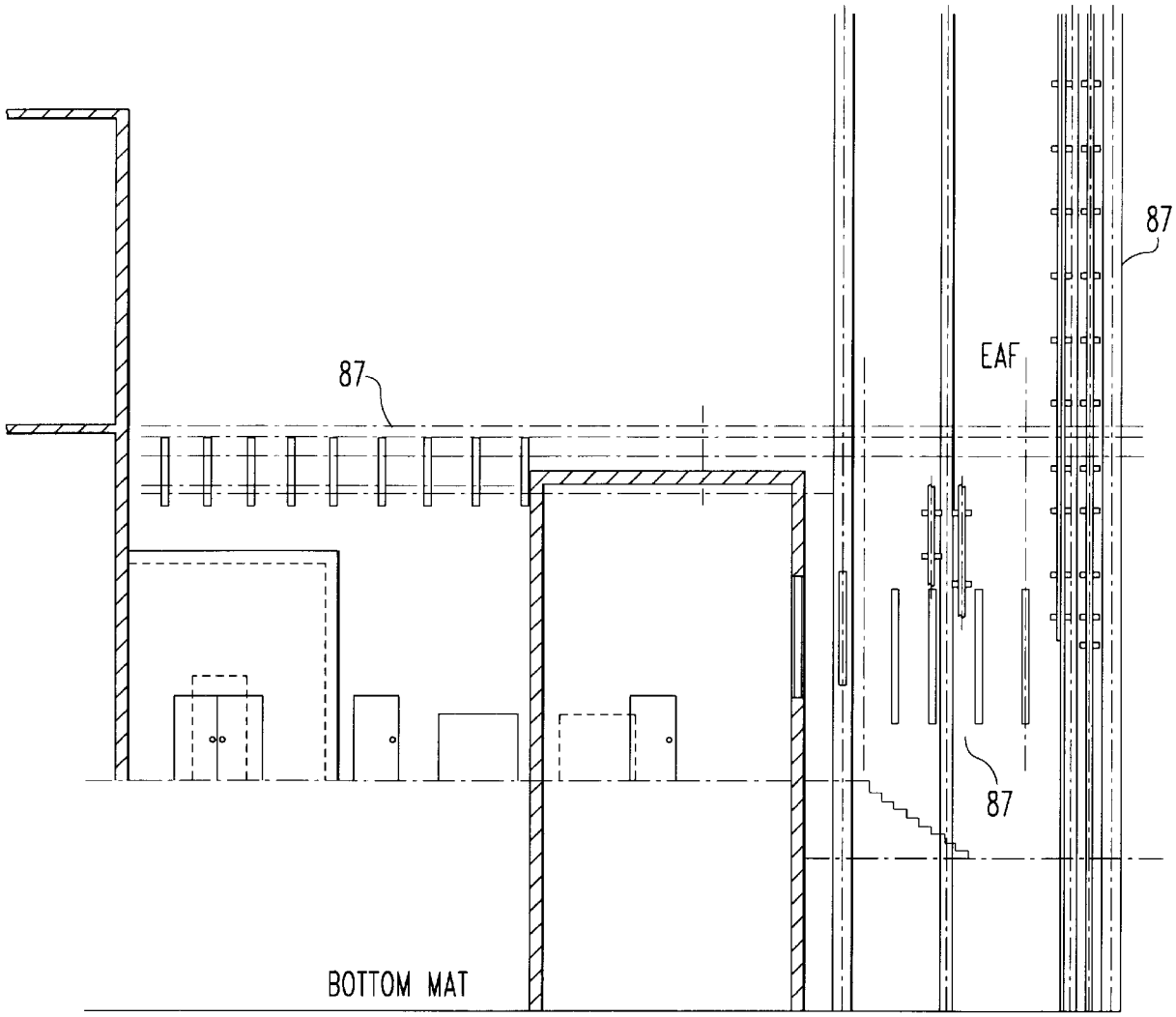
FIG. 7 is a schematic representation of a side view of the bus of the furnace.

A typical operation sequence consists of removing the furnace cover 8 from the furnace shell 9 of the vessel 48, placing the charge material 44 (typically scrap iron and/or steel) in the furnace shell 9, putting the furnace cover 8 back on the furnace shell 9, energizing the DC furnace power supply 1 (which include, for instance, rectifiers of the power supply mechanism 46), and lowering the top electrode 5 to establish an arc 54 between the charge material which is electrically in contact with the bottom electrode 11 and the tip of the top electrode 5. This arcing continues until the charge material is melted. At this time, if additional molten material 44 is required, the above sequence will be repeated one or more times, or it might be desirable to continuously feed unmelted iron substitutes such as pre-reduced iron pellets into the molten charge material at a rate which corresponds to the capability of the furnace to melt it. This will continue until such time that the required total amount of molten material in the furnace is reached. At that point in time, the furnace is tapped (the molten material is poured into another vessel 69, see FIG. 4) for further processing.

A DC arc furnace comprises a refractory lined vessel to contain the material 44 to be melted and/or heated. There is a furnace cover 8 to contain the energy in the vessel during the process. There are one or more top electrodes protruding through the furnace cover 8 and movable vertically to obtain the desired distance between the bottom tip of the electrode (s) and the material 44 to be melted (heated). There are one or more removable or fixed bottom electrode(s) 11 located in the refractory lining of the bottom of the furnace shell 9. There are one or more DC power supplies electrically connected to the top and bottom electrodes such that an arc(s) 54 can be established between the top electrode(s) and the material to be melted (heated).

Figure 8:
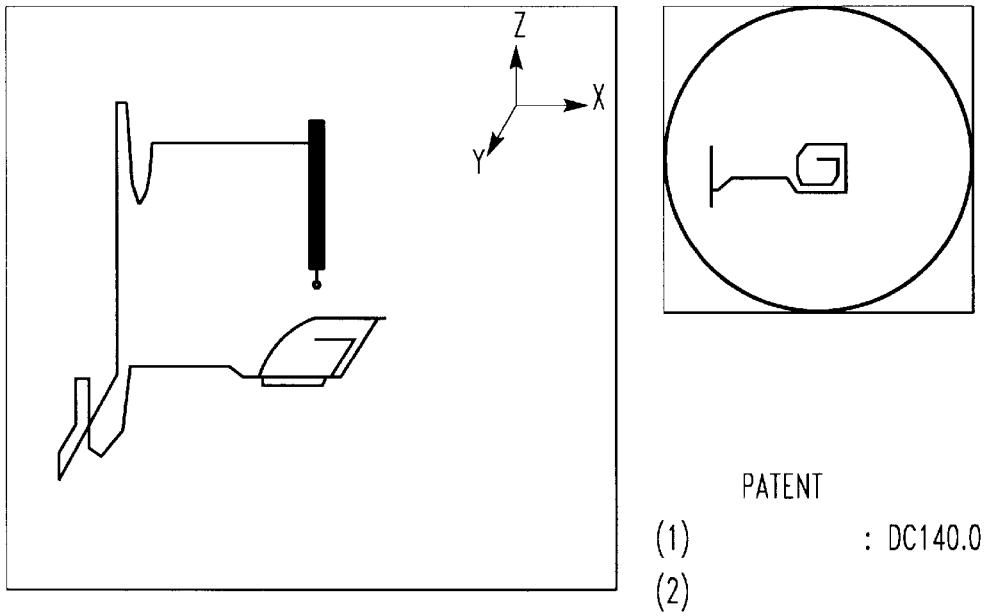
FIG. 8 is a schematic representation of a first embodiment of the conductor.
Figure 9:
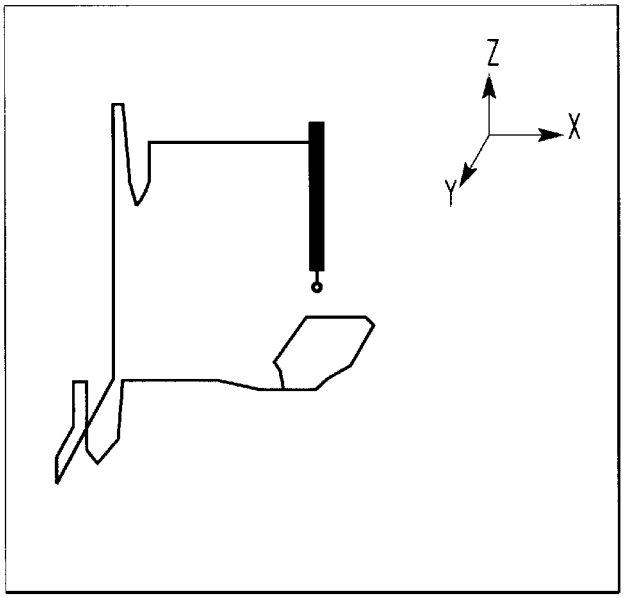
FIG. 9 is a schematic representation of a second embodiment of the conductor.
Figure 9:
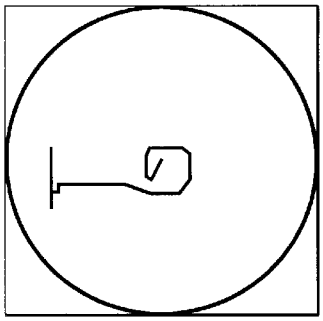
Figure 10:
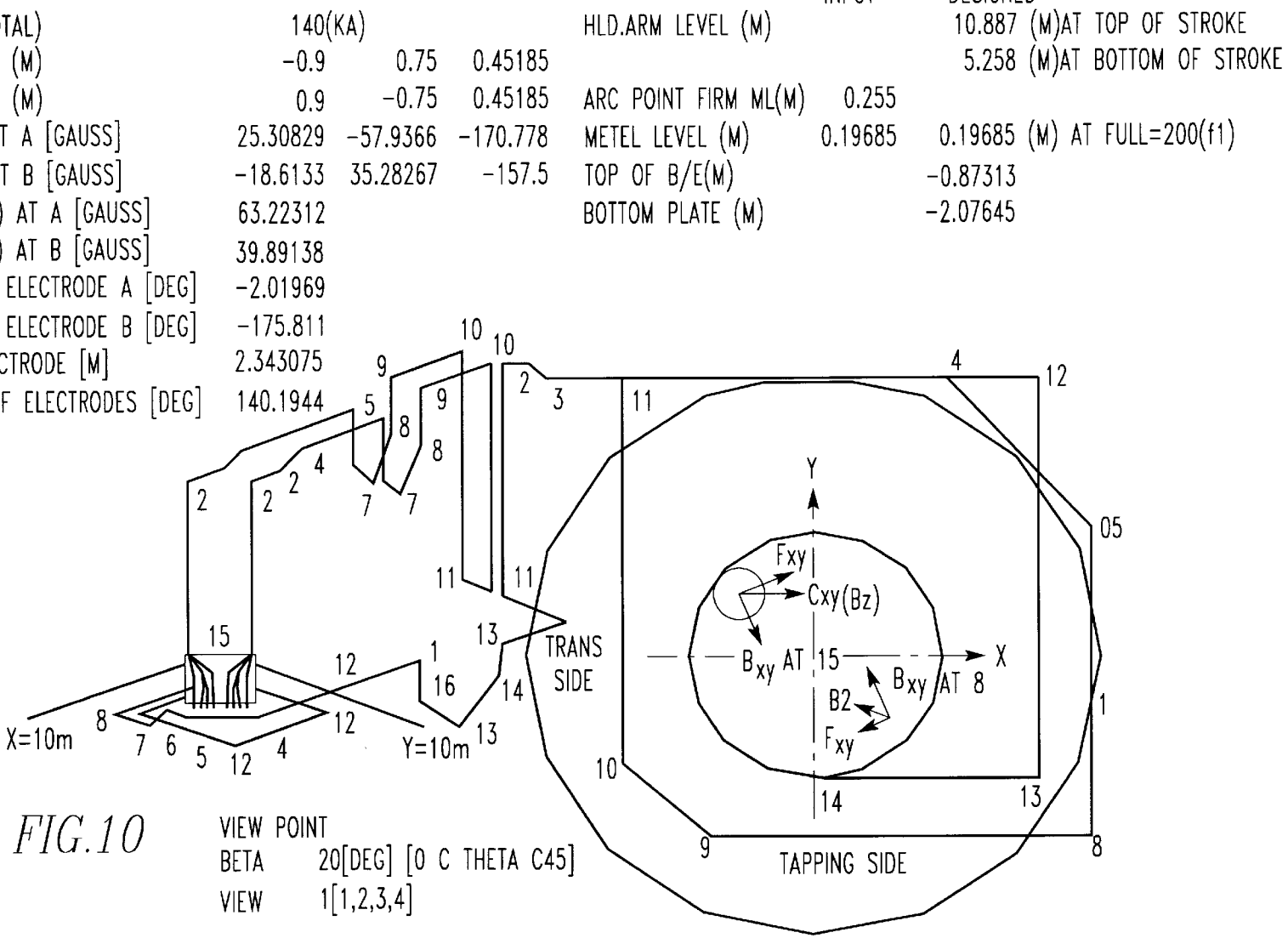
FIG. 10 is a schematic representation of the points on the conductor for magnetic field identification.

As the current flows through the conductor 71 and follows the current path defined by the conductor 71, magnetic fields are created. The magnetic fields are defined by the current in the conductor 71 and the shape of the conductor 71. As shown in FIGS. 3 and 5–7, from the bus 87, the conductor 71 loops about the center axis 99 of the vessel 48 and creates magnetic fields which are essentially all in the vertical direction or z direction and essentially not at all in the horizontal direction or X and Y directions. By the magnetic field present about the first top electrode 5*a* being essentially all in the vertical direction, the deflection of the arc is guided by the vertical magnetic fields to be essentially vertically oriented toward the metal 48 and the bottom of the vessel 48. FIG. 8 and FIG. 9 show two different embodiments of the conductor 71 as it loops around the center axis 99. The appendix lists the magnetic field values at locations around the conductor 71 of FIGS. 8 and 9. The points for magnetic field identification are defined in FIG. 10. It is desired, and as shown in the Appendix, the vertical magnetic field is much larger than the horizontal magnetic fields which are essentially nonexistent.

The same vertical magnetic fields that pass to the melted metal 44 cause the metal to be stirred because the metal is reactive with the magnetic fields. The magnetic fields which exist in the molten metal 44 cause it to stir or move around and thus cause different parts of the molten metal 44 to be exposed to heat. By continually being heated, the molten metal will not have a chance to solidify and form icebergs.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

APPENDIX

| No. | Bx | By | Bz [Gauss] | X | Y | Z STARTING POINT |
|---|---|---|---|---|---|---|
| 1 | 0.00 | 12.63 | 0.00 | 0.00 | 0.00 | 8.75 |
| 2 | 0.00 | 0.81 | 0.00 | −8.50 | 0.00 | 8.75 |
| 3 | −0.33 | 2.73 | −0.40 | −8.50 | 0.00 | 7.75 |
| 4 | −0.23 | 1.15 | −0.34 | −9.02 | −0.40 | 5.47 |
| 5 | −0.09 | −0.53 | −0.30 | −9.54 | −0.72 | 4.75 |
| 6 | 0.19 | −2.97 | −0.26 | −10.06 | −1.04 | 5.47 |
| 7 | 0.00 | 0.20 | 0.03 | −10.58 | −1.44 | 9.75 |
| 8 | −1.01 | 7.76 | 0.00 | −11.03 | −1.44 | 9.75 |
| 9 | −0.01 | 0.11 | −0.01 | −11.03 | −1.44 | 0.80 |
| 10 | −0.80 | 6.07 | 0.00 | −10.93 | −1.44 | 0.70 |
| 11 | −2.66 | 0.00 | 4.79 | −10.93 | −1.44 | −5.37 |
| 12 | −0.44 | −0.94 | 0.00 | −10.93 | 5.06 | −5.37 |
| 13 | 0.62 | 0.00 | −1.45 | −10.93 | 5.06 | −3.96 |
| 14 | −0.65 | −2.23 | 0.00 | −10.93 | 3.17 | −3.96 |
| 15 | 0.00 | 0.15 | 0.22 | −10.93 | 3.17 | −1.50 |
| 16 | 1.20 | 3.61 | −0.37 | −10.22 | 3.17 | −1.50 |
| 17 | 0.31 | 0.95 | −0.10 | −10.50 | 2.86 | −5.48 |
| 18 | 0.00 | −0.20 | −0.08 | −9.82 | 2.55 | −6.31 |
| 19 | −0.82 | −4.07 | −0.28 | −8.99 | 2.24 | −5.48 |
| 20 | 0.00 | 6.32 | 4.61 | −8.72 | 1.94 | −1.96 |
| 21 | −8.04 | 2.58 | 13.22 | −3.75 | 1.94 | −1.96 |
| 22 | 0.00 | 17.40 | 32.05 | −2.00 | 3.50 | −1.20 |
| 23 | 5.64 | −2.27 | 4.44 | 2.90 | 3.50 | −1.20 |
| 24 | 14.91 | 0.00 | 17.48 | 2.93 | 2.40 | −1.80 |
| 25 | 4.92 | −3.60 | 6.35 | 2.93 | −0.40 | −1.80 |
| 26 | 0.00 | −33.78 | 16.34 | 2.90 | −1.50 | −2.40 |
| 27 | −8.46 | −7.99 | 6.60 | −1.00 | −1.50 | −2.40 |
| 28 | −3.08 | −2.14 | 2.25 | −1.85 | −0.60 | −2.40 |
| 29 | −7.67 | 0.00 | 5.19 | −2.10 | −0.24 | −2.40 |
| 30 | −7.11 | 0.00 | 4.52 | −2.10 | 0.70 | −2.40 |
| 31 | −6.02 | 3.44 | 5.97 | −2.10 | 1.70 | −2.40 |
| 32 | 0.00 | 17.20 | 15.26 | −1.50 | 2.75 | −2.40 |
| 33 | 6.13 | 2.92 | 5.55 | 1.50 | 2.75 | −2.40 |
| 34 | 13.35 | 0.00 | 8.61 | 2.00 | 1.70 | −2.40 |
| 35 | 0.00 | −1.81 | 0.00 | 2.00 | 0.00 | −2.40 |
| 36 | 0.00 | 0.57 | 0.00 | 1.80 | 0.00 | −2.40 |
| 37 | 0.00 | −24.01 | 0.00 | 1.80 | 0.00 | −2.30 |
| TOTAL | −0.16 | 0.6 | 150.20 | | | |
| 1 | 0.00 | 12.63 | 0.00 | 0.00 | 0.00 | 8.75 |
| 2 | 0.00 | 0.81 | 0.00 | −8.50 | 0.00 | 8.75 |
| 3 | −0.33 | 2.73 | −0.40 | −8.50 | 0.00 | 7.75 |
| 4 | −0.23 | 1.15 | −0.34 | −9.02 | −0.40 | 5.47 |
| 5 | −0.09 | −0.53 | −0.30 | −9.54 | −0.72 | 4.75 |
| 6 | 0.19 | −2.97 | −0.26 | −10.06 | −1.04 | 5.47 |
| 7 | 0.00 | 0.20 | 0.03 | −10.58 | −1.44 | 9.75 |
| 8 | −1.01 | 7.76 | 0.00 | −11.03 | −1.44 | 9.75 |
| 9 | −0.01 | 0.11 | −0.01 | −11.03 | −1.44 | 0.80 |
| 10 | −0.80 | 6.07 | 0.00 | −10.93 | −1.44 | 0.70 |

APPENDIX-continued

| No. | Bx | By | Bz [Gauss] | X | Y | Z STARTING POINT |
|---|---|---|---|---|---|---|
| 11 | −2.66 | 0.00 | 4.79 | −10.93 | −1.44 | −5.37 |
| 12 | −0.44 | −0.94 | 0.00 | −10.93 | 5.06 | −5.37 |
| 13 | 0.62 | 0.00 | −1.45 | −10.93 | 5.06 | −3.96 |
| 14 | −0.65 | −2.23 | 0.00 | −10.93 | 3.17 | −3.96 |
| 15 | 0.00 | 0.15 | 0.22 | −10.93 | 3.17 | −1.50 |
| 16 | 1.20 | 3.61 | −0.37 | −10.22 | 3.17 | −1.50 |
| 17 | 0.31 | 0.95 | −0.10 | −10.50 | 2.86 | −5.48 |
| 18 | −0.18 | −0.20 | 0.18 | −9.82 | 2.55 | −6.31 |
| 19 | −1.18 | −3.94 | 0.09 | −8.99 | 2.55 | −5.48 |
| 20 | 0.00 | 5.70 | 5.47 | −8.72 | 2.55 | −1.96 |
| 21 | −4.02 | 9.21 | 14.50 | −3.75 | 2.55 | −1.96 |
| 22 | 0.00 | 10.88 | 15.23 | −1.00 | 3.50 | −1.80 |
| 23 | 6.35 | 5.20 | 11.35 | 1.60 | 3.50 | −1.80 |
| 24 | 14.07 | 0.00 | 15.93 | 2.83 | 2.00 | −1.80 |
| 25 | 4.81 | −7.21 | 6.60 | 2.83 | −0.40 | −1.80 |
| 26 | 0.00 | −44.93 | 17.97 | 1.93 | −1.00 | −1.80 |
| 27 | −9.11 | −4.56 | 5.47 | −1.00 | −1.00 | −1.80 |
| 28 | −2.45 | 0.00 | 1.28 | −1.30 | −0.40 | −1.80 |
| 29 | −27.47 | 0.00 | 14.28 | −1.30 | −0.24 | −1.80 |
| 30 | −1.87 | 2.80 | 2.99 | −1.30 | 1.80 | −1.80 |
| 31 | 5.55 | 4.16 | 1.11 | −1.00 | 2.00 | −1.80 |
| 32 | 19.47 | 7.79 | 0.00 | −0.80 | 2.00 | −2.80 |
| TOTAL | 0.04 | 0.02 | 114.26 | | | |

What is claimed is:

1. A direct current electric arc furnace for melting or heating raw material or molten material comprising:

a refractory lined vessel for holding raw or molten material in its interior;

at least a first top electrode, said first top electrode entering the vessel interior above the raw or molten material;

at least a first bottom electrode mounted in the bottom of the vessel and in electrical contact with the raw or molten material in the vessel;

an electrical power supply mechanism which electrically connects to the top electrode and the bottom electrode in order to input electrical energy into the material through the top and bottom electrodes in the form of an arc, said bottom electrode having opposite electrical polarity to the electrical polarity of the top electrode; and a mechanism for stirring the molten material in the vessel and guiding the arc in the vessel, said stirring and guiding mechanism in communication with the interior of the vessel and connected to the power supply mechanism.

2. A direct current electric arc furnace for melting or heating raw material or molten material comprising:

a refractory lined vessel for holding raw or molten material in its interior, said vessel having a vertical axis, the vessel has a vertical direction and a horizontal direction, said molten metal creating a pool having a surface which forms a plane parallel with the horizontal direction of the vessel when the molten material is molten;

at least a first top electrode, said first top electrode entering the vessel interior above the raw or molten material;

at least a first bottom electrode mounted in the bottom of the vessel and in electrical contact with the raw or molten material in the vessel;

an electrical power supply mechanism which electrically connects to the top electrode and the bottom electrode in order to input electrical energy into the material through the top and bottom electrodes in the form of an arc, said bottom electrode having opposite electrical polarity to the electrical polarity of the top electrode; and a mechanism for stirring the molten material in the vessel and guiding the arc in the vessel, said stirring and guiding mechanism in communication with the interior of the vessel and connected with the power supply mechanism, the stirring and guiding mechanism also provides electrical current to the bottom electrode and is connected to the bottom electrode, the stirring and guiding mechanism includes an electrical conductor connected to the power supply mechanism and the bottom electrode, said electrical conductor configured to generate magnetic fields which limits the deflection of the arc in the horizontal direction and directs deflection of the arc in the vertical direction, said conductor is disposed outside of the vessel, the conductor forms a loop essentially in the horizontal direction about the vertical center axis, the conductor forms at least one closed loop essentially in the horizontal direction about the vertical center axis, the conductor to the bottom electrode produces a magnetic field in the vertical direction of at least 100G of direct current.

3. A furnace as described in claim 1 wherein the stirring and guiding mechanism also provides electrical current to the bottom electrode and is connected to the bottom electrode.

4. A furnace as described in claim 3 wherein the stirring and guiding mechanism includes an electrical conductor connected to the power supply mechanism and the bottom electrode.

5. A furnace as described in claim 4 wherein the vessel has a vertical direction and a horizontal direction, said molten material creating a pool having a surface which forms a plane parallel with the horizontal direction of the vessel when the molten material is molten, said electrical conductor configured to generate magnetic fields which limits the deflection of the arc in the horizontal direction and directs deflection of the arc in the vertical direction.

6. A furnace as described in claim 5 wherein said conductor is disposed outside of the vessel.

7. A furnace as described in claim 6 wherein the vessel has a vertical center axis and the conductor forms a loop essentially in the horizontal direction about the vertical center axis.

8. A furnace as described in claim 7 wherein the conductor forms at least one closed loop essentially in the horizontal direction about the vertical center axis.

9. A furnace as described in claim 8 wherein the conductor connected to the bottom electrode produces a magnetic field in the vertical direction of at least 100G of direct current.

10. A furnace as described in claim 9 wherein the current carried by the conductor to the bottom electrode is 140 KA.

11. A furnace as described in claim 10 wherein the conductor produces a magnetic field of at least 100G in the vertical direction and less than 10G in the horizontal direction.

12. A furnace as described in claim 11 wherein the conductor produces a magnetic field of at least 140G in the vertical direction and less than 1G in the horizontal direction.

13. A furnace as described in claim 11 wherein the conductor produces a magnetic field of at least 100G in the vertical direction and less than 0.5G in the horizontal direction.

14. A method for operating a direct current arc furnace comprising the steps of:

guiding direct current from an electrical power supply mechanism to a bottom electrode connected to a refractory lined vessel in a current path defined by an electrical conductor connected to the bottom electrode and the power supply mechanism which groups about the center axis of the vessel;

melting metal in the vessel with an arc that is formed from a first top electrode which has direct current provided to it, and has an electrical polarity opposite of the electrical polarity of the bottom electrode; and stirring the molten metal with forces generated by a magnetic field created by the current in the conductor and at the same time deflecting the arc essentially entirely in a vertical direction while essentially preventing the arc deflection in a horizontal direction with the magnetic field.

* * * * *